US007635171B2

(12) United States Patent
Rapier, III

(10) Patent No.: US 7,635,171 B2
(45) Date of Patent: Dec. 22, 2009

(54) TIP OUT HINGE

(75) Inventor: James L. Rapier, III, Kernersville, NC (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 0 days.

(21) Appl. No.: 10/924,540

(22) Filed: Aug. 24, 2004

(65) Prior Publication Data

US 2006/0043850 A1 Mar. 2, 2006

(51) Int. Cl.
*E06B 1/00* (2006.01)
*E05F 1/08* (2006.01)

(52) U.S. Cl. ..... 312/321.5; 16/286

(58) Field of Classification Search ..... 312/319.1, 312/319.2, 325, 326, 327, 328; 16/286
See application file for complete search history.

(56) References Cited

U.S. PATENT DOCUMENTS 2,213,319 A * 9/1940 Lickteig ..... 217/60 E
3,810,275 A * 5/1974 Smith ..... 16/298
4,347,644 A * 9/1982 Lautenschlager et al. ..... 16/50
4,635,763 A * 1/1987 Omata ..... 188/268
4,729,616 A * 3/1988 Vogt ..... 312/325
4,756,054 A * 7/1988 Mitts et al. ..... 16/237
4,843,680 A * 7/1989 Cress et al. ..... 16/289
5,388,901 A * 2/1995 Asano ..... 312/222
5,462,347 A * 10/1995 Vogelgesang et al. ..... 312/247
5,664,290 A * 9/1997 Scherrer ..... 16/370
6,471,310 B2 * 10/2002 Montagna ..... 312/223.2
6,921,141 B1 * 7/2005 Porco ..... 312/100
6,979,067 B2 * 12/2005 Yang ..... 312/334.46

* cited by examiner

*Primary Examiner*—Janet M Wilkens
*Assistant Examiner*—Timothy M Ayres
(74) *Attorney, Agent, or Firm*—Brinks Hofer Gilson & Lione

(57) ABSTRACT

A tip out hinge designed for use with a storage container located within a cabinet. The hinge provides easy access to the contents of a storage container located within a cabinet. For example, the tip out hinge is used on a tip out storage container in a bathroom for clothing or bathroom items. It also provides access to a storage facility located behind a false front in a bathroom or kitchen. The tip out hinge permits the storage unit to tip forward from the cabinet, remain open until closing begins, remain closed even when bumped, provide a large opening for easy access to the storage container and will not interfere with the operation of any doors or drawers located below the tip out storage container.

3 Claims, 1 Drawing Sheet

TIP OUT HINGE

BACKGROUND OF THE INVENTION

1. Field of Invention

This invention relates to hinges, and more particularly, to a tip out hinge which will permit a storage container located within a cabinet to be tipped forward out of the cabinet to an open position, remain in the open condition until urged backwardly to the fully closed position.

2. Background of the Prior Art

It has become essential to utilize all available space in kitchens, bathrooms, closets and other storage areas in an efficient manner to maximize storage capacity and convenience. Such space savers include, for example, rotating "Lazy Susan" structures designed to utilize the dead space in corners of kitchen cabinets.

Another frequently under utilized storage area in a kitchen or bathroom is the area behind a false front. A conventional drawer cannot be used to provide storage for this area because of the close proximity of a sink or bin. The usual way of solving this problem is to attach a storage tray to the inside of the false front to allow the false front to be tipped forward, thereby providing access to the area behind the false front. Rev-A-Shelf, Inc. located in Jeffersontown, Ky. designed and marketed a tilt out hinge for use on a storage compartment within a cabinet that utilized a base plate, a pair of pivot bars, a bracket connected to the pivot bars, and a spring secured between the base plate and one of the pivot bars. The hinge functioned quite properly except that the spring configuration did not assist in the operation of the hinge to the extent desired. A more decisive component for controlling the opening and closing operations for the storage container was needed, and it is to this need that the present invention is directed.

In particular, it is the object of the present invention to provide a tip out hinge for use with a storage container within a cabinet.

Another object of the present invention is to provide a tip out hinge which will attach to a false front for the opening and closing of a false front.

Still another object of the present invention to provide a tip out hinge that has a decisive spring component that will positively and distinctly control operation of the false front in the closed-to-open and open-to-closed positions.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention of the application, which is measured by its claims, nor to limit its scope in any way.

Thus, the objectives of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

SUMMARY OF THE INVENTION

The present invention is a tip out hinge for use with a cabinet which includes a base plate securable to a cabinet, a pair of pivot bars secured to the base plate, and a bracket secured to the pivot bars. A spring is secured between the base plate and one of the pivot bars. The hinge provides a safe and reliable means for securing a tip out storage system within a cabinet to furnish additional storage space that combines the advantages of tipping out from the front of the unit, returning the storage system once the once the storage system is partially closed and remaining closed until opened. The hinge will not interfere with the operation of any doors or drawers of the cabinet located below the tip out unit.

DETAILED DESCRIPTION OF PREFERRED EMBODIMENT

Figure 3:
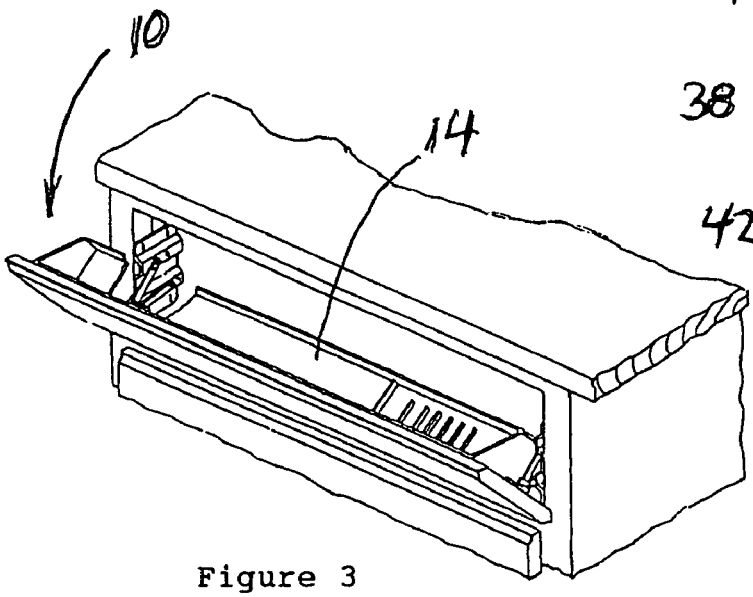
FIG. 3 is a front perspective view of the right side tip out hinge connected to a false front in operation in a cabinet.
Figure 1:
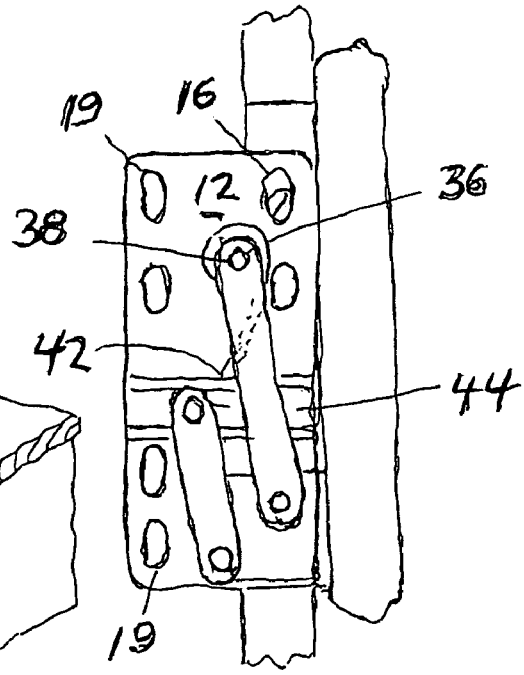
FIG. 1 is a front elevational view of the right side tip out hinge secured in its closed position within a cabinet with a false front secured to a bracket of the hinge.
Figure 2:
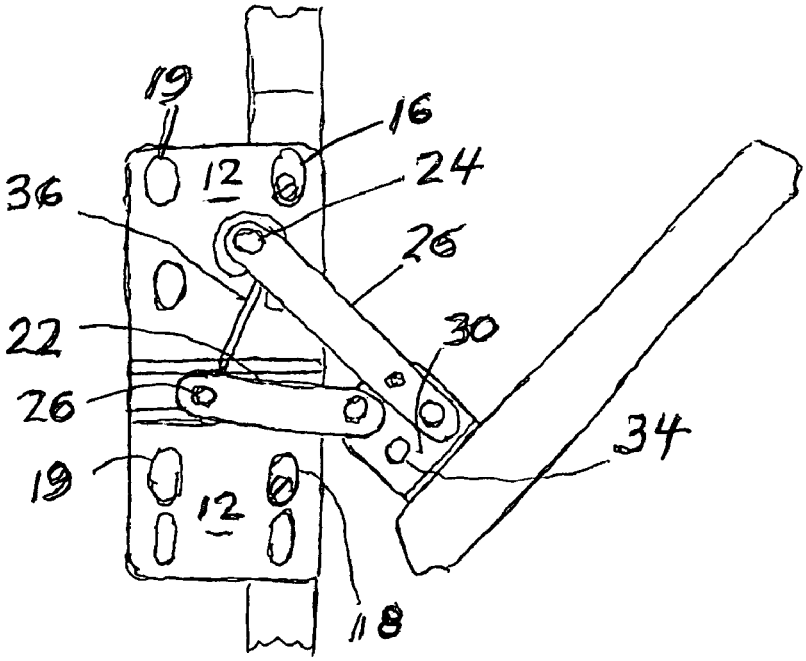
FIG. 2 is a front elevational view of the right side tip out hinge secured in its open position within a cabinet with a false front secured to a bracket of the hinge.

Referring now to the drawings and particularly to FIG. 3, a tip out false drawer front located in the front of a sink shown generally as 10 carries a flat rectangular base plate 12. The height and width of base plate 12 can be any convenient size sufficient to support the tip out hinge 10 and the storage container 14 attached to false front 10. In a preferred embodiment, base plate 12 is from about 2 to 5 inches in height and from about 1 to 32 inches in width.

Base plate 12 is secured to the opening in the cabinet by securing means passing through a set of openings 16, 18, each configured to allow for minor adjustments in the height of the base plate when it is being secured to the cabinet opening. Although only top opening 16 and bottom opening 18 are needed to secure base plate to the opening in the cabinet, two parallel openings 19 are preferably provided so base plate may be used on either side of the cabinet opening. Base plate 12 may be of any conventional material commonly used for the manufacture of hinges and can be secured to the cabinet frame by any conventional securing means.

First and second pivot bars 20, 22 are secured to base plate 12 by any conventional fastening means which allows them to rotate about the axis of that fastening means. Pivot bars 20, 22 are secured to base plate 12 by rivets 24, 26 running through both the base plate 12 and openings in the first end of the pivot bars.

Secured to the end of each of the pivot bars opposite to where they are secured to base plate 12 is a bracket 28 to which a storage container or false front 10 is fastened. Bracket 28 is L-shaped, formed from a generally rectangular metal plate which has been bent at a 90 degree angle to form two perpendicular portions 30, 32 of the bracket. When secured to the pivot bars, one of the two portions 30 of the L shaped bracket is parallel to the base plate and the other portion 32 projects approximately perpendicular to the surface of base plate 12.

The portion of bracket 28 which is parallel to base plate 12 contains four openings 34 two of which are used to secure the second end of each of the pivot bars to the bracket. The openings in bracket 28 which are used to secure each of the bars to the bracket are located diagonally across from each other.

A spring 36 is used with the tip out hinge to hold the hinge in the closed position and to return it to that closed position once closure of the storage container begins. Spring 36 is preferably a coiled spring secured to base plate 12 with the coiled portion engaging the base plate/pivot bar pin 38 and the free end 40 extending through an aperture 42 in a central raised portion 44 of base plate 12.

In operation, two tip out hinges are secured to the inside frame of a cabinet opening, one on each end. False front 10 is secured to the brackets of the tip out hinges. Storage container 14 is secured to the inside surface of the false front by a securing means such as screws, bolts or other conventional securing means to provide storage space within the cabinet. Upon opening of false front 10, the top lip of the false front tips out from the cabinet while the bottom of the false front both raises and comes forward slightly from the cabinet. This movement creates increased access to the storage container within the cabinet.

From the description, it can be seen that a novel tip out hinge has been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will occur to those skilled in the art, and it is not desired to limit the invention to the exact construction and operation shown and described. All suitable modifications and equivalents that fall within the scope of the appended claims are deemed within present inventive concept.

What is claimed is:

1. A tip out hinge for use within a cabinet comprising:

a base plate having a planar upper portion proximate a raised middle portion, and a planar lower portion that is co-planar with the planar upper portion;

wherein the raised middle portion has a side defining a hole sized to receive on end of a torsion spring, the plate being configured to be securable to the frame of a cabinet;

a first pin connected to the planar upper portion of the base plate, wherein the pin has a raised portion projecting away from the planar upper portion of the base plate;

first and second movable pivot bars, each bar having a first end rotatably secured to the base plate, the first pivot bar being rotatably connected to an outer end of the raised portion of the first pin;

a bracket secured to a second end of each of the first and second rotatable pivot bars; and a torsion spring having a coil, the coil being coiled around the raised portion of the first pin between the planar upper portion of the base plate and the first movable pivot bar, the torsion spring having a second end spaced from the coil and secured by the hole defined in the side of the raised middle portion of the base plate to supply a substantially linear closing force, the spring having an arm portion coupling the spring second end to the coil, the arm portion of the spring being located between the planar upper portion of the base plate and the first movable pivot bar when the hinge is in a closed position.

2. The hinge of claim 1, further comprising a false front connected to the bracket.

3. A tip out hinge comprising:

a base plate having a planar upper portion, a raised middle portion, and a planar lower portion co-planar with the planar upper portion, the base plate being securable to the frame of a cabinet, wherein the raised middle portion has a side defining a hole sized to receive one end of a torsion spring;

a first pin projecting from the planar upper portion of the base plate to a distal end;

a first movable pivot bar having an upper and lower end, wherein the upper end of the first pivot bar is rotatably secured to the distal end of the first pin and is offset from the planar upper portion of the base plate;

a second movable pivot bar having an upper and lower end, the upper end of the second pivot bar being rotatably secured to the raised middle portion of the base plate, a bracket secured to the lower ends of both the first and second pivot bars; and a spring having a coil, the coil being secured around the first pin and in between the planar upper portion of the base plate and the first movable pivot bar, the spring having a second end spaced from the coil that is secured by the hole defined in the side of the raised middle portion, the spring having an arm portion coupling the spring second end to the coil;

thereby enabling movement of the hinge between a closed position and a biased open position and back to the closed position, and thereby establishing a substantially linear closing force, the arm portion of the spring being located between the planar upper portion of the base plate and the first movable pivot bar when the hinge is in the closed position.

* * * * *